US010070697B1

(12) United States Patent
Melgoza

(10) Patent No.: US 10,070,697 B1
(45) Date of Patent: Sep. 11, 2018

(54) POP-TWIST LOCK FASTENER

(71) Applicant: Phoebe James, Inc., New York, NY (US)

(72) Inventor: Raul Melgoza, New York, NY (US)

(73) Assignee: Phoebe James, Inc., Dover, DE (US)

( * ) Notice: Subject to any disclaimer, the term of this patent is extended or adjusted under 35 U.S.C. 154(b) by 85 days.

(21) Appl. No.: 15/271,210

(22) Filed: Sep. 20, 2016

(51) Int. Cl.

| | |
|---|---|
| ***A44B 1/04*** | (2006.01) |
| ***A44B 1/44*** | (2006.01) |
| ***A44B 1/14*** | (2006.01) |
| ***A44B 1/18*** | (2006.01) |

(52) U.S. Cl.
CPC ..... *A44B 1/44* (2013.01); *A44B 1/04* (2013.01); *A44B 1/14* (2013.01); *A44B 1/18* (2013.01)

(58) Field of Classification Search
CPC .... A44B 1/44; A44B 1/14; A44B 1/18; A44B 1/04; A44B 1/20
See application file for complete search history.

(56) References Cited

U.S. PATENT DOCUMENTS

| | | | | |
|---|---|---|---|---|
| 875,816 A | | 1/1908 | Holmes | |
| 1,178,738 A | | 4/1916 | Lichter | |
| 1,180,104 A | | 4/1916 | Barnes | |
| 1,341,771 A | | 6/1920 | Allender | |
| 1,355,162 A | | 10/1920 | Opitz | |
| 1,452,539 A | * | 4/1923 | White | A44B 1/44 24/95 |
| 1,452,540 A | * | 4/1923 | White | A44B 1/44 24/95 |
| 1,482,940 A | | 2/1924 | Munzer | |
| 1,505,501 A | | 8/1924 | Siehl | |
| 1,510,089 A | | 9/1924 | Kellog | |
| 1,511,445 A | | 10/1924 | Clarkson | |
| 1,594,416 A | | 8/1926 | Kellog | |
| 1,658,573 A | | 2/1928 | Roper et al. | |
| 1,776,096 A | | 9/1930 | Alland | |
| 2,061,467 A | * | 11/1936 | Kimbell | A44B 1/44 29/524.1 |
| 2,224,179 A | | 12/1940 | Brautigam | |
| 2,279,259 A | | 4/1942 | Ballou | |

(Continued)

FOREIGN PATENT DOCUMENTS

| | | |
|---|---|---|
| GB | 528028 | 10/1940 |
| GB | 2045335 A | 10/1980 |

(Continued)

*Primary Examiner* — Jason W San
(74) *Attorney, Agent, or Firm* — Werschulz Patent Law, LLC; Patricia P. Werschulz, Esq.

(57) ABSTRACT

A fastener assembly that allows a user to change the appearance of a leather good such as clothing or an accessory by interchangeably attaching ornamentation to clothing or accessory, changing the appearance of the leather good. The fastener assembly is easy to use and only requires a user to place an ornament having an anchor attached over a base attached to a leather good and rotating to lock the ornament in place. The fastener assembly has a plurality of flanges on the anchor that prevent the ornament from rotating and falling off the base. A disk magnet inside the anchor further locks the ornament onto the base. The fastener assembly is useful for a wide variety of clothing and accessories made of leather or leather-like materials. The style of ornament is without limit.

16 Claims, 12 Drawing Sheets

(56) References Cited

U.S. PATENT DOCUMENTS 2,411,987 A 12/1946 D'Antonio
2,436,323 A 2/1948 Nygard
2,751,654 A 6/1956 Armbuster
3,195,201 A 7/1965 Ash
3,237,203 A 3/1966 Nielsen
3,355,780 A 12/1967 Daddona
3,469,290 A 9/1969 Andrews
3,512,226 A 5/1970 Carlile
4,253,226 A 3/1981 Takeda
4,458,395 A 7/1984 Aoki
4,471,510 A 9/1984 Derosa
D285,670 S 9/1986 Osawa
4,654,934 A 4/1987 Hasegawa
4,672,718 A * 6/1987 Schlueter ..... A44B 1/04 24/113 R
4,736,494 A 4/1988 Marchesi
4,751,038 A * 6/1988 Schlueter ..... A44B 1/04 264/247
4,969,241 A * 11/1990 Griffin ..... A44B 1/14 24/113 MP
5,016,368 A 5/1991 Cassata
5,426,828 A 6/1995 Kusano
D373,303 S 9/1996 Bailey
D375,061 S 10/1996 Morita
5,575,043 A 11/1996 Candotti
5,606,780 A 3/1997 Kusano
D401,889 S 12/1998 Wong
D403,952 S 1/1999 Podell
5,868,445 A 2/1999 Kaufman
D413,282 S 8/1999 Aoki
5,983,464 A * 11/1999 Bauer ..... A45C 13/1069 24/303
6,035,494 A 3/2000 Duke et al.
D426,765 S * 6/2000 Aoki ..... D11/220
6,163,938 A 12/2000 Weber-Unger
6,170,131 B1 * 1/2001 Shin ..... A41F 1/002 24/303
6,175,963 B1 1/2001 Loeffelholz
6,182,336 B1 2/2001 Bauer
6,226,853 B1 7/2001 Ho
6,282,760 B1 9/2001 Mars
D457,834 S 5/2002 Morita
D462,255 S 9/2002 Aoki
6,477,749 B1 * 11/2002 Reiter ..... A41F 1/002 24/303
6,497,003 B2 12/2002 Calabrese
6,606,767 B2 8/2003 Wong
6,757,945 B2 7/2004 Shibuya et al.
6,991,598 B2 * 1/2006 Klein ..... A61F 5/41 600/38
7,546,661 B2 6/2009 Connor
7,607,205 B2 10/2009 Grunberger et al.
7,640,636 B2 1/2010 Clark
7,698,836 B2 4/2010 Schmelzer et al.
7,744,051 B2 6/2010 Joyce et al.
8,122,519 B2 2/2012 Schmelzer et al.
8,122,567 B2 2/2012 Connor
8,353,544 B2 * 1/2013 Fiedler ..... A45C 13/1069 24/303
8,402,605 B2 * 3/2013 Courtin ..... B60N 3/046 16/4
9,961,966 B2 * 5/2018 Ryan ..... A44B 1/14
2004/0117894 A1 * 6/2004 Kuo ..... A42B 1/248 2/209.13
2004/0226145 A1 11/2004 Ouellette et al.
2007/0006502 A1 * 1/2007 Schmelzer ..... A43B 3/0078 40/636
2008/0289076 A1 11/2008 Millward
2010/0242230 A1 9/2010 Cohen
2010/0269239 A1 10/2010 Kulp et al.
2011/0041295 A1 2/2011 Reiter
2011/0041363 A1 * 2/2011 Stanfield ..... A43B 1/0054 36/136
2011/0079046 A1 4/2011 Rosenberg
2011/0079573 A1 * 4/2011 Nakamura ..... B65D 43/0231 215/331
2011/0219587 A1 9/2011 Nizan et al.
2011/0265289 A1 11/2011 Wu
2011/0298227 A1 * 12/2011 Fiedler ..... A45C 13/1069 292/251.5
2012/0015120 A1 1/2012 Haegele et al.
2012/0285046 A1 11/2012 Chapin et al.
2013/0247335 A1 * 9/2013 Chow ..... A44B 1/08 24/3.7
2014/0101897 A1 * 4/2014 Clark ..... A44B 1/14 24/113 R
2014/0318181 A1 * 10/2014 Malvar ..... A44C 1/00 63/20
2015/0128383 A1 * 5/2015 Ryan ..... A44B 1/14 24/92
2016/0000189 A1 * 1/2016 Bolen ..... A44B 1/08 24/303
2016/0153485 A1 * 6/2016 Kleppen ..... F16B 19/10 411/502
2017/0196313 A1 * 7/2017 Marin ..... A44B 1/14

FOREIGN PATENT DOCUMENTS

GB 2226227 A 6/1990
JP 408038222 A 2/1996
JP 2000-287721 10/2000
JP 3166572 U 3/2011
WO 02/060292 A1 8/2002
WO 06/119978 A1 11/2006
WO 2009/127196 A3 10/2009

* cited by examiner

POP-TWIST LOCK FASTENER

TECHNICAL FIELD

The present disclosure relates generally to a device for fastening a clothing ornament. More particularly, the present disclosure relates to a locking fastener assembly for attaching an ornament to clothing and accessories made of leather and leather-like material.

BACKGROUND

People love to add special touches to their clothing, by adding a touch of color or sparkle to brighten their appearance. Often it is the accessory that takes an ordinary dress or suit and turns it into something special.

The reason people love accessories is because they can change them so that the same outfit will look different when the one accessory is interchanged with another.

Many accessories are worn without attaching to the clothing itself. Pocket squares, necklaces, scarves, ties, belts, to name a few, are simply added on. Interchanging these accessories is simple.

However, some accessories attach to garments and to other accessories themselves. For example, lapel pins and brooches attach to garments using a pin as a fastener.

Pins are limited in their ability to penetrate anything but cloth. Pins generally are useless when attaching anything to leather or leather-like material. For example, a leather belt is too thick and stiff for an ordinary pin to penetrate.

Adding an accessory to shoes that can later be interchanged with another is not possible using pins. Any accessory added to a shoe or any type of footwear must be securely fastened so that it does not loosen or fall off when the wearer is walking.

Hook and loop fasteners are not secure enough to withstand the stress of walking. Generally, once an accessory such as an ornament is attached to shoe, it is so secure that is cannot be removed or interchanged to restyle the shoe.

Typically, ornaments are permanently sewn or glued directly onto the footwear or other leather goods which severely limits the ability of the wearer to make any changes. Pins or even hook and loop fasteners do not work well with footwear and other leather goods because of their limitations.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a fastener assembly that allows a user to change the appearance of a good such as an article of clothing or accessory. Accordingly, the present disclosure provides a fastener assembly that allows a user to interchangeably attach ornamentation to an article of clothing or accessory, changing the appearance of the good.

Another aspect of an example embodiment in the present disclosure is to provide a fastener assembly that is easy to use when interchanging ornaments. Accordingly, the present disclosure provides a fastener assembly that only requires a user to place an ornament with an attached anchor over a base coupled to a good and rotate to lock the ornament in place.

A further aspect of an example embodiment in the present disclosure is to provide a fastener assembly that locks an interchangeable ornament in place on clothing or an accessory. Accordingly, the present disclosure provides a fastener assembly having a plurality of flanges on the anchor that prevent the ornament from rotating and falling off the base.

The present disclosure describes a fastener assembly that allows a user to change the appearance of a leather good such as clothing or an accessory by interchangeably attaching ornamentation to clothing or accessory, changing the appearance of the leather good. The fastener assembly is easy to use and only requires a user to place an ornament having an attached anchor over a base coupled to a leather good and rotating to lock the ornament in place. The fastener assembly has a plurality of flanges on the anchor that prevent the ornament from rotating and falling off the base. Preferably, a disk magnet inside the anchor further locks the ornament onto the base. The fastener assembly is useful for a wide variety of clothing and accessories made of leather or leather-like materials. The style of ornament is without limit.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

FIG. 10' is a sectional side-cut view along the line A-A of FIG. 10.

FIG. 11' is a sectional side-cut view along the line B-B of FIG. 10.

FIG. 12A' is a cross-section view of the base inside the anchor.

FIG. 12B', similar to FIG. 12A', is a cross-section view of the anchor rotating around the base.

FIG. 12C', similar to FIG. 12B', is a cross-section view of the anchor locked in place around the base.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
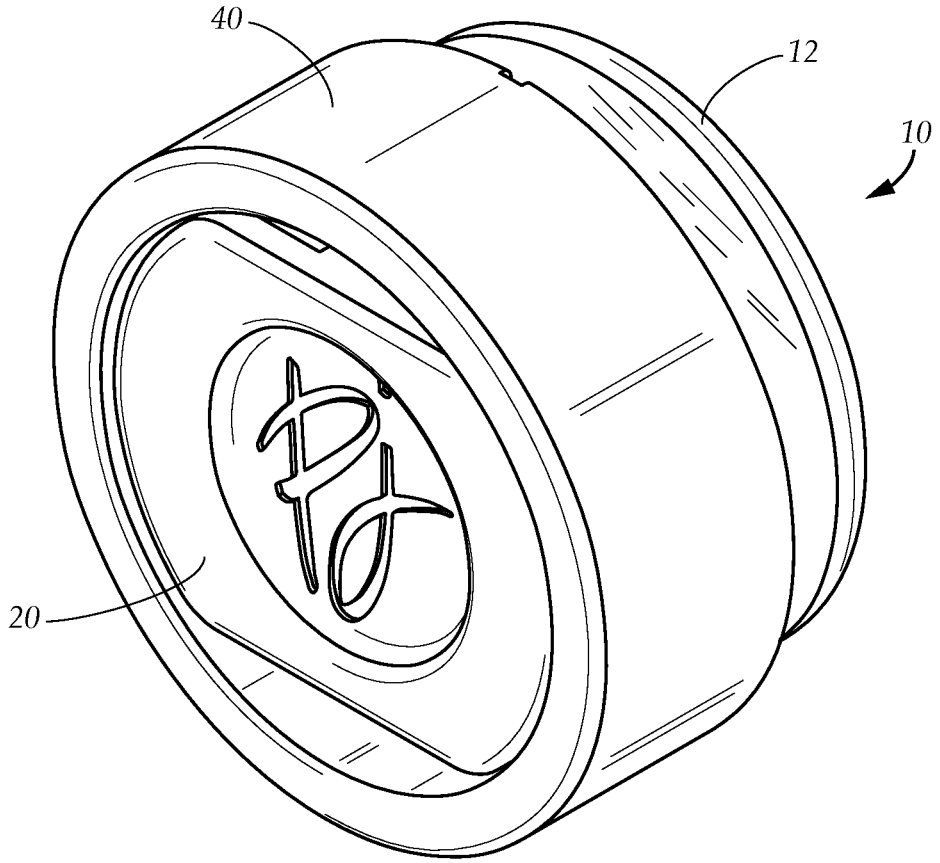
FIG. 1 is a perspective view of an example embodiment of a slide lock fastener assembly.

FIG. 1 illustrates an example embodiment of a fastener assembly 10 for selectively attaching an ornament to a leather good. In FIG. 1, three components of the fastener assembly are shown without the ornament or leather good. The fastener assembly in its simplest embodiment comprises a base 20, an anchor 40 and a grommet 12 that attaches the base to the leather good.

Figure 2A:
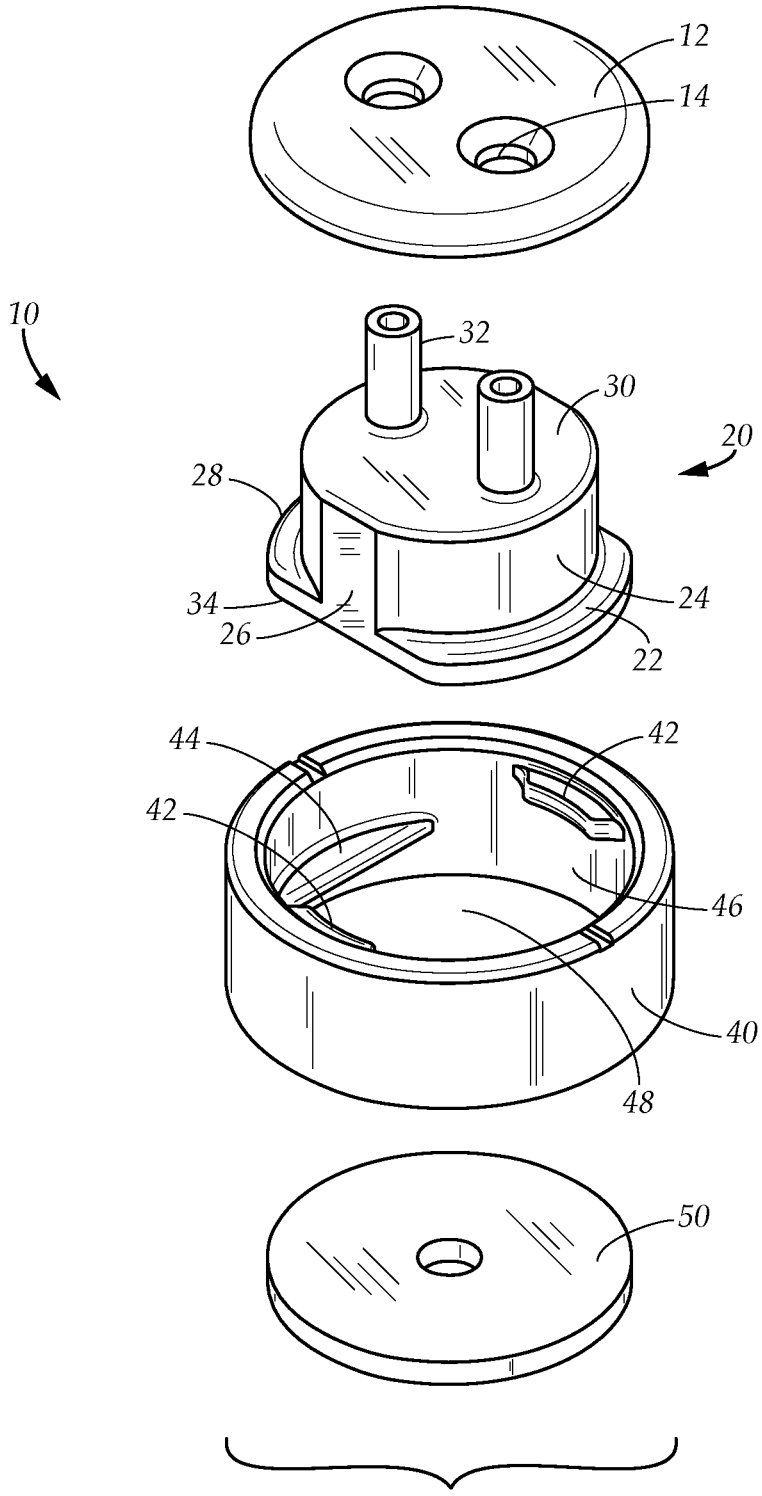
FIG. 2A is an exploded perspective view from above of another example embodiment of a slide lock fastener assembly.
Figure 2B:
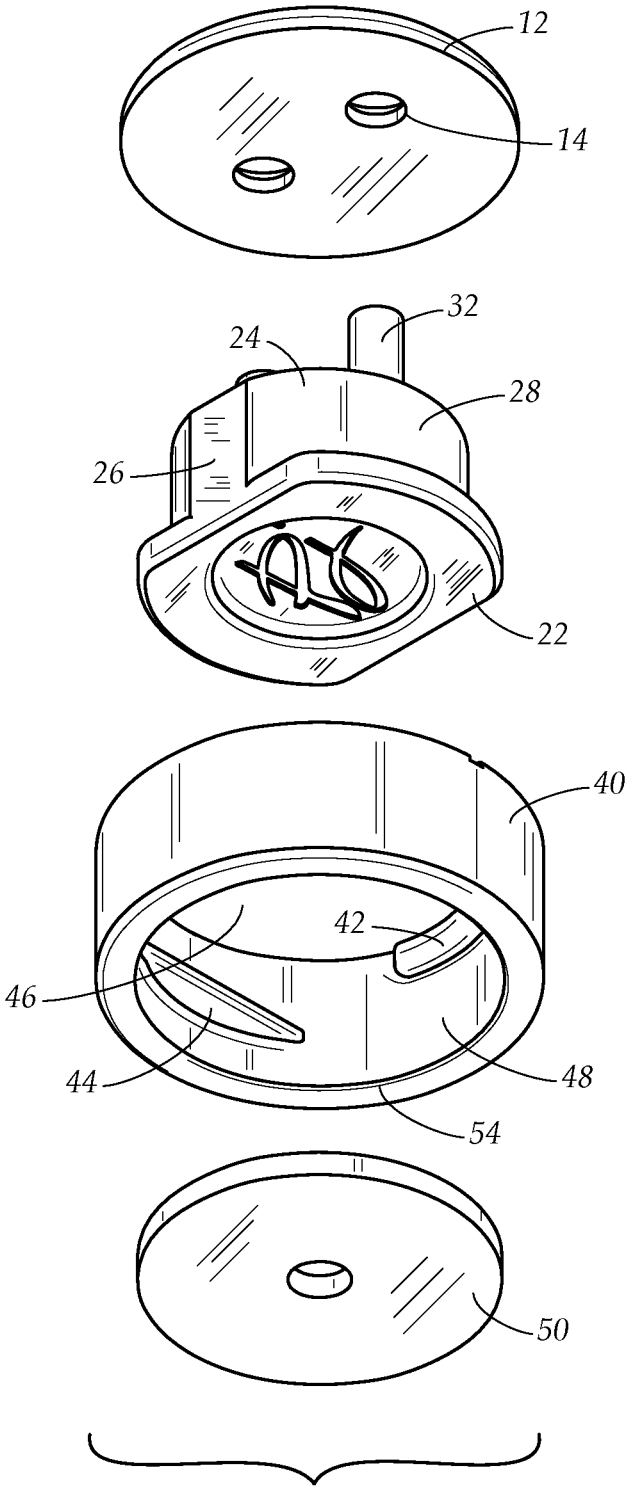
FIG. 2B, similar to FIG. 2A, is an exploded perspective view from below of the example embodiment of a slide lock fastener assembly.

Shown in FIGS. 2A and 2B, in a further preferred example embodiment of the fastener assembly is a further component of the fastener assembly 10, a disk magnet 50. While the fastener assembly without the magnet is functional, the fastener assembly 10 with the disk magnet 50 is the preferred configuration. FIGS. 2A and 2B are exploded perspective views and FIG. 2B is shown in a perspective inverted from FIG. 2A.

The base 20 has a core 24 having a flat ovoid horizontal cross-section with a top 34, a bottom 30, a pair of flat sides 26 opposite each other and a pair of arcuate sides 28 connecting the flat sides 26 to form the core 24. The arcuate sides 28 have a lip 22 at the top of the core 24, but the flat sides 26 lack the lip and are flat from the top 34 of the core 24 to the bottom 30. The lip 22 itself is flat on the side adjacent to the flat sides 26 of the core 24.

The anchor 40 is an open collar defining a cavity 48 therein, the cavity 48 having an entry 46 and an exit 54. The anchor 40 has a first pair of opposing flanges 42 inside the anchor near the entry 46 to the cavity 48 configured for guiding the base 20 into the cavity 48 of the anchor 40 when coupling the base 20 to the anchor 40.

The anchor 40 has a second pair of opposing flanges 44 near the cavity exit 54, orthogonal to the first pair of flanges 42, the first set of flanges 44 one-half turn from the second set of flanges 44.

The base 20 has a bottom 30 with at least one rivet 32, the at least one rivet, preferably two, inserting into the leather good and fastening on a reverse side of the leather good by the grommet 12 having at least one opening 14, preferably two.

Figure 3:
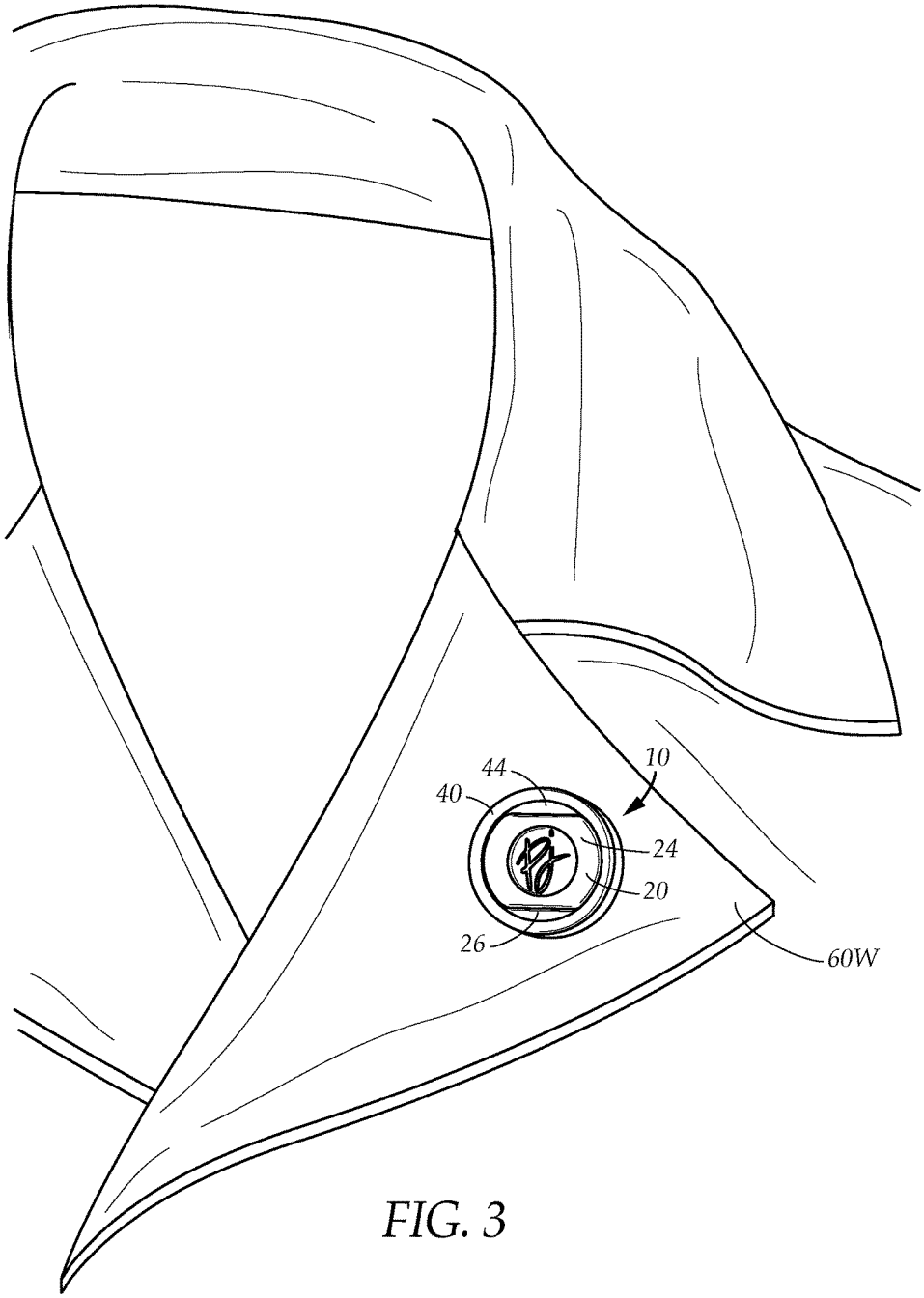
FIG. 3 is a perspective view of the example embodiment of a slide lock fastener assembly attaching to a leather lapel.

FIG. 3 shows the fastener assembly 10 attaching to a leather lapel 60W. The disk magnet is not shown, nor is the ornament for the sake of clarity. The base 20 permanently attaching to the leather lapel 60W. The anchor 40 surrounds the base 20, the second pair of flanges 44 snug against the flat sides 26 of the base core 24. The second pair of flanges 44 prevent further rotation of the base 20 inside the anchor 40.

The term "leather" in the present application refers not just to natural leather, but encompasses leather-like material, both natural and synthetic as well as fabric and materials having sufficient structure and bulk to support the fastener assembly. The term "leather" can mean for example, but not limited to, the treated skins and hides of animals, including mammals, birds and fish as well as to synthetic durable and flexible material with the properties of natural leathers, such as kirza, bicast leather, vegan leather, poromeric imitation leather, and Naugahyde®. (Naugahyde® is the registered trademark of Uniroyal Engineered Products, Sarasota, Fla. 34236.) The term also can include fabric, materials and cloth such as linen, canvas and duckcloth, providing the structure and bulk is sufficient to support the fastener assembly.

The term "good" in the present application refers to clothing and accessories. When combined with the term "leather" as defined hereinabove, as in "leather good," it includes, for example, but not limited to, clothing articles such as shirts, sweaters, sweatshirts, jackets and coats, as well as leather trim on the clothing articles listed hereinabove; headwear such as caps, visors, headbands; footwear such as boots, shoes, pumps, sandals and slippers. It includes, but not limited to, accessories such as belts, jewelry made from leather or having leather trim, such as charms, necklaces, earrings, rings, arm cuffs, bracelets, watches, watch straps, tie pins and cuff links, as well as accessories such as clutch bags, clutch purses, handbags, purses, wallets and tote bags and even extends to accessories for a pet such as dog leashes, dog collars and leads.

Figure 10:
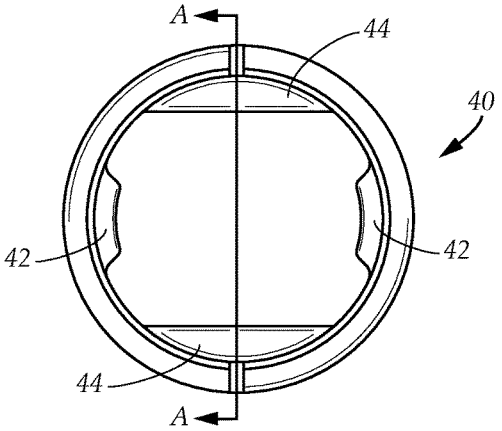
FIG. 10 is a top plan view of the anchor.
Figure 10:
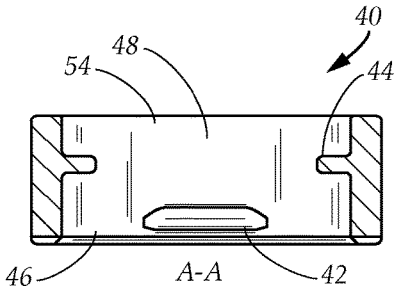
Figure 11:
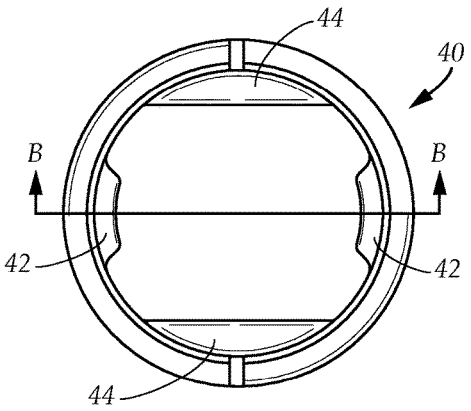
FIG. 11 is a top plan view of the anchor, identical to FIG. 10, except for the line B-B.
Figure 11:
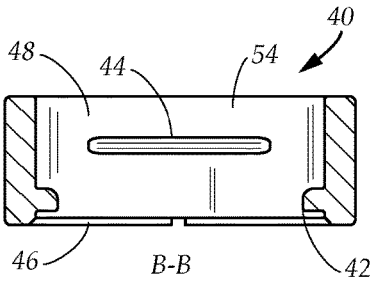

FIGS. 10, 10', 11 and 11' show the internal structure of the anchor 40. The first pair of opposing flanges 42 are near or substantially adjacent to the entry 46 to the cavity 48. The second pair of opposing flanges 44 are towards the exit 54 of the cavity 48, allowing room for the disk magnet 50 to be placed in the exit 54 in a further example embodiment. The two pairs of flanges 42, 44 are orthogonal to each other, being one-half turn rotation apart.

Figure 12A:
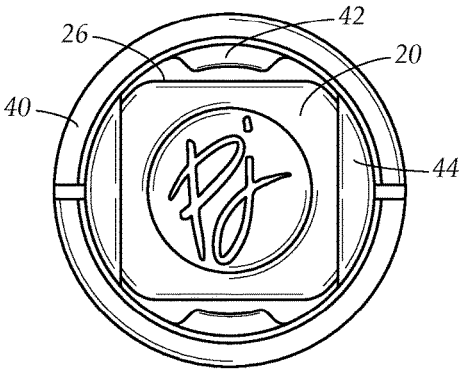
FIG. 12A is a top plan view of the base inside the anchor.
Figure 12A:
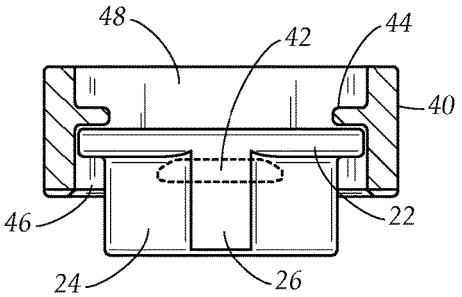

FIGS. 12A, 12A',12B, 12B', 12C and 12C' show the process of the base 20 engaging the flanges 42, 44 when the anchor 40 is disposed on the base. In FIGS. 12A and 12A', the anchor 40 is place over the base so the flat sides 26 of the base are aligned with the first pair of flanges 42. The second pair of flanges 44 prevent the base 20 from further entry into the anchor 40.

Figure 12B:
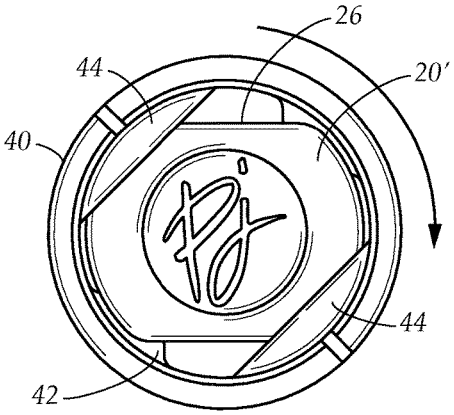
FIG. 12B, similar to FIG. 12A is a top plan view of anchor rotating around the base.
Figure 12B:
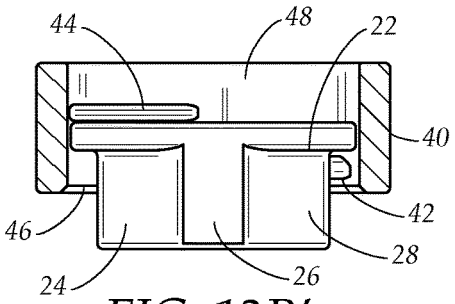

FIGS. 12B and 12B' show a one-quarter turn rotation of the anchor 40 around the base 20. The base 20 cannot move further into the anchor 40, still blocked by the second set of flanges 44. The first set of flanges 42 prevent the removal of the anchor 40 from the base 20.

Figure 12C:
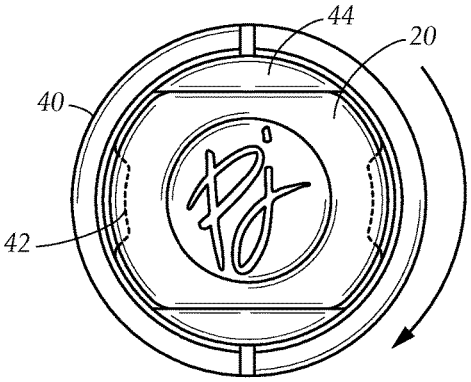
FIG. 12C, similar to FIG. 12B, is a top plan view of the anchor locked in place around the base.
Figure 12C:
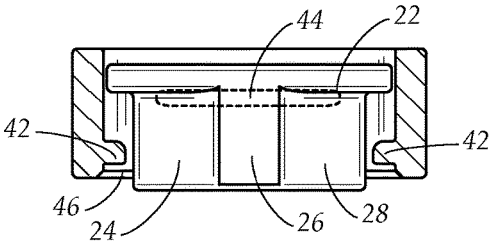

FIGS. 12C and 12C' show the anchor and base after a full half-turn rotation. The base 20 is fulling disposed within the anchor 40, the lip 22 of the base 20 engaged with the first pair of flanges 42, preventing the removal of the anchor 40 from the base. The flat sides of the base 20 are snug against the second pair of flanges 44, preventing further rotation of the anchor 40, locking the anchor and any attached ornament in place.

FIGS. 4-9 demonstrate a method of selectively attaching an ornament to a piece of leather used as a complete article of clothing or accessory or as a trim. The type of clothing or accessory is not a limitation nor is the type of leather or leather-like material as explained hereinabove.

Figure 4:
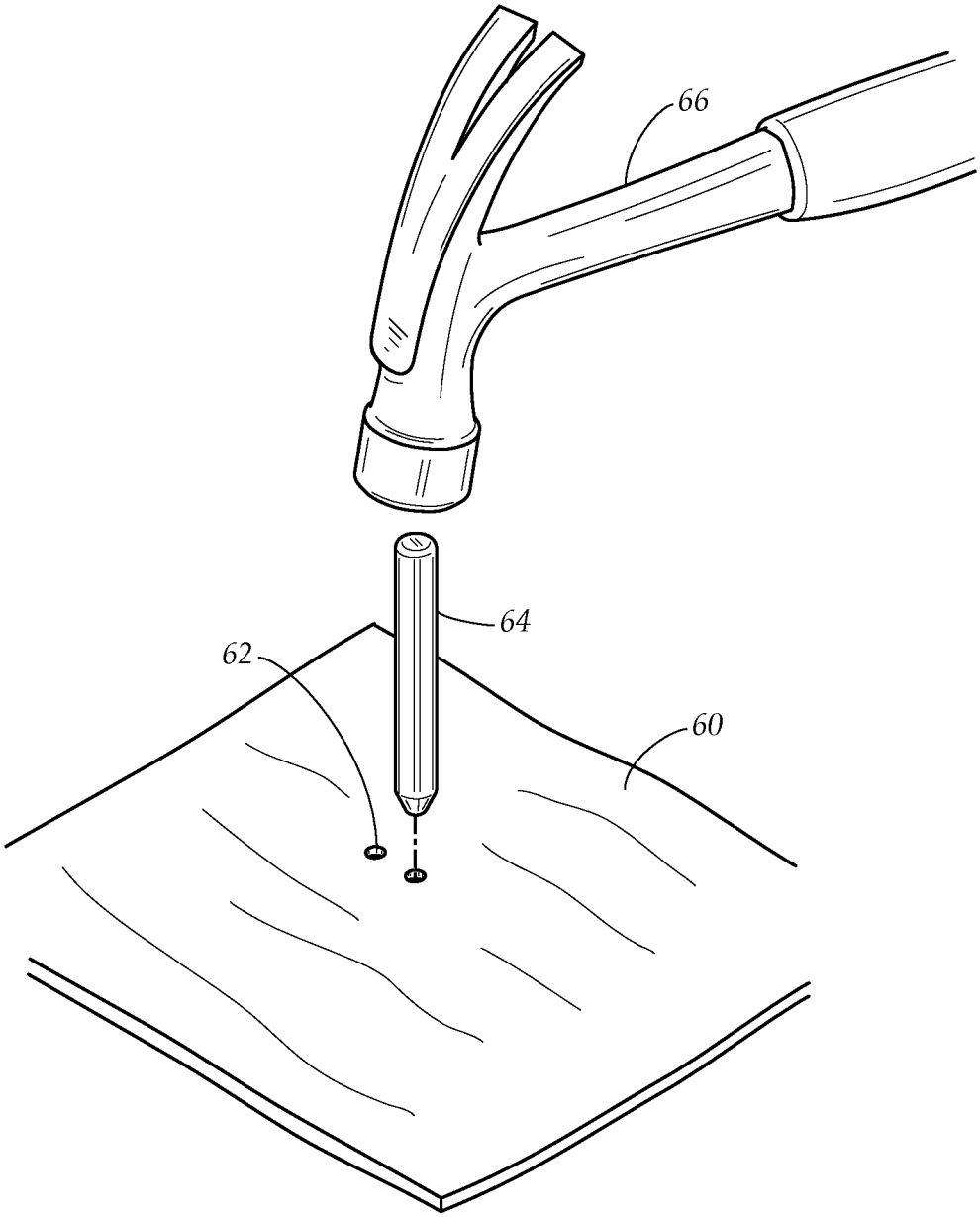
FIG. 4 is a perspective view of preparing a leather portion for receiving the slide lock fastener assembly.
Figure 5:
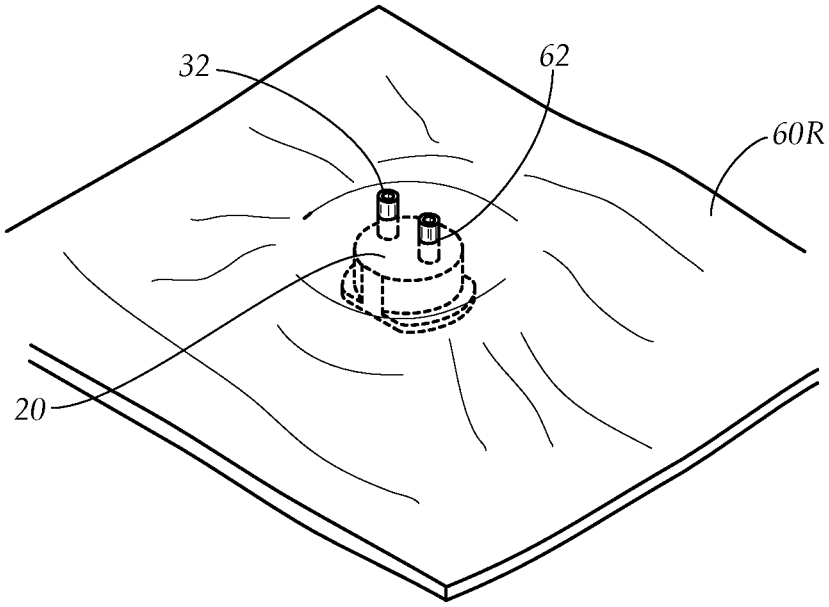
FIG. 5 is a perspective view of placing a base of the slide lock fastener assembly into the leather portion.
Figure 6:
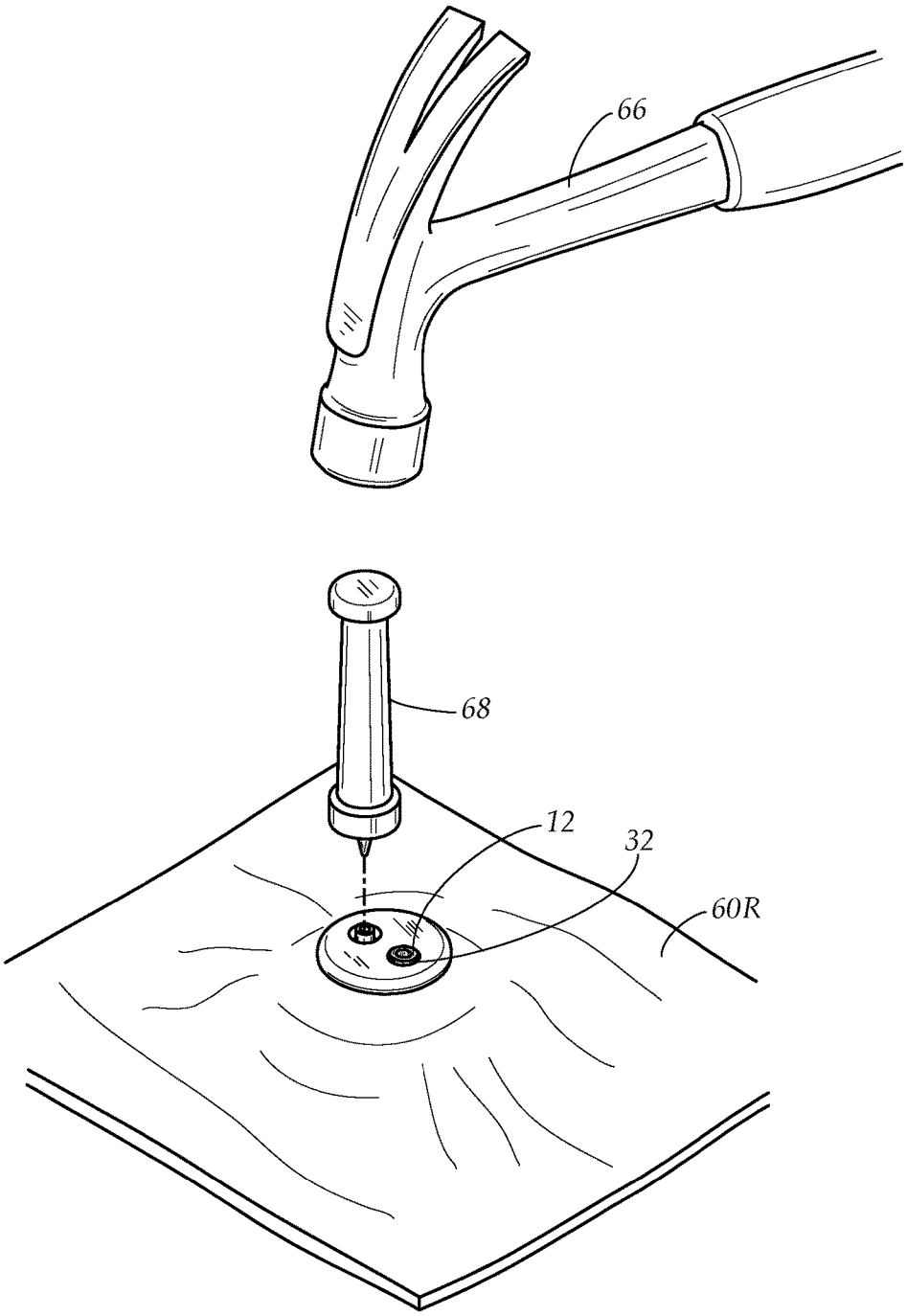
FIG. 6 is a perspective view of tapping a pair of rivets into a grommet, fixing the base onto the leather portion.

As shown in FIG. 4, at least one hole 62, preferably two, is punched by hammer 66 and awl 64 into a piece of leather 60. FIG. 5 shows the at least one rivet 32 of base 20 inserting into the at least on hole 62, the rivets protruding into the reverse side of the leather 60R. FIG. 6 shows the grommet 12 with the at least one opening 14 placed over the rivets 32 on the reverse side of the leather 60R and a peening tool 68 being struck by the hammer 66, peening the at least one rivet 32.

Figure 7:
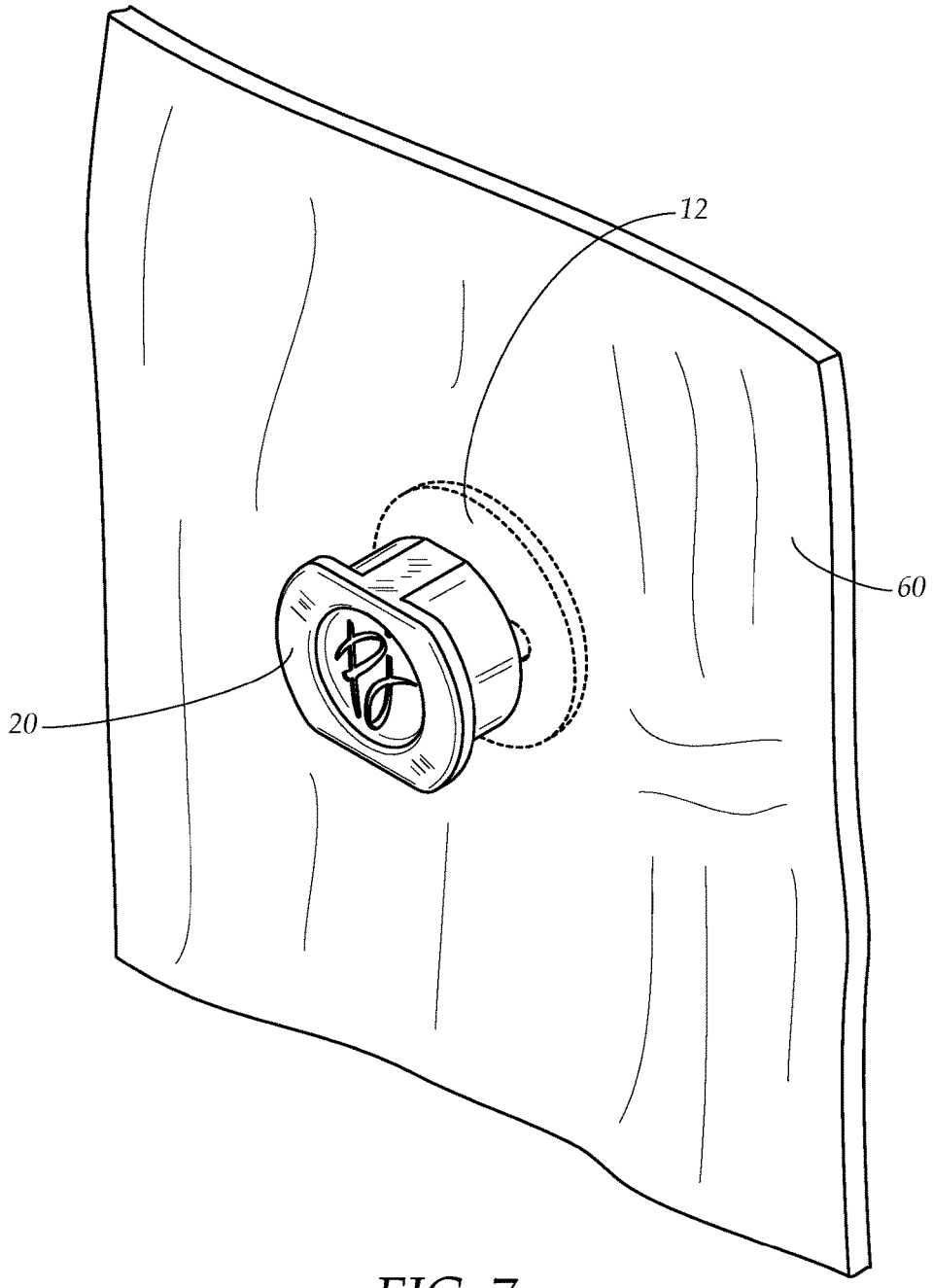
FIG. 7 is a perspective view of the base in place on the leather portion.

As shown in FIG. 7, the base 20 permanently attaches to the leather good 60, held in place by the grommet 12 on the reverse side.

Figure 8:
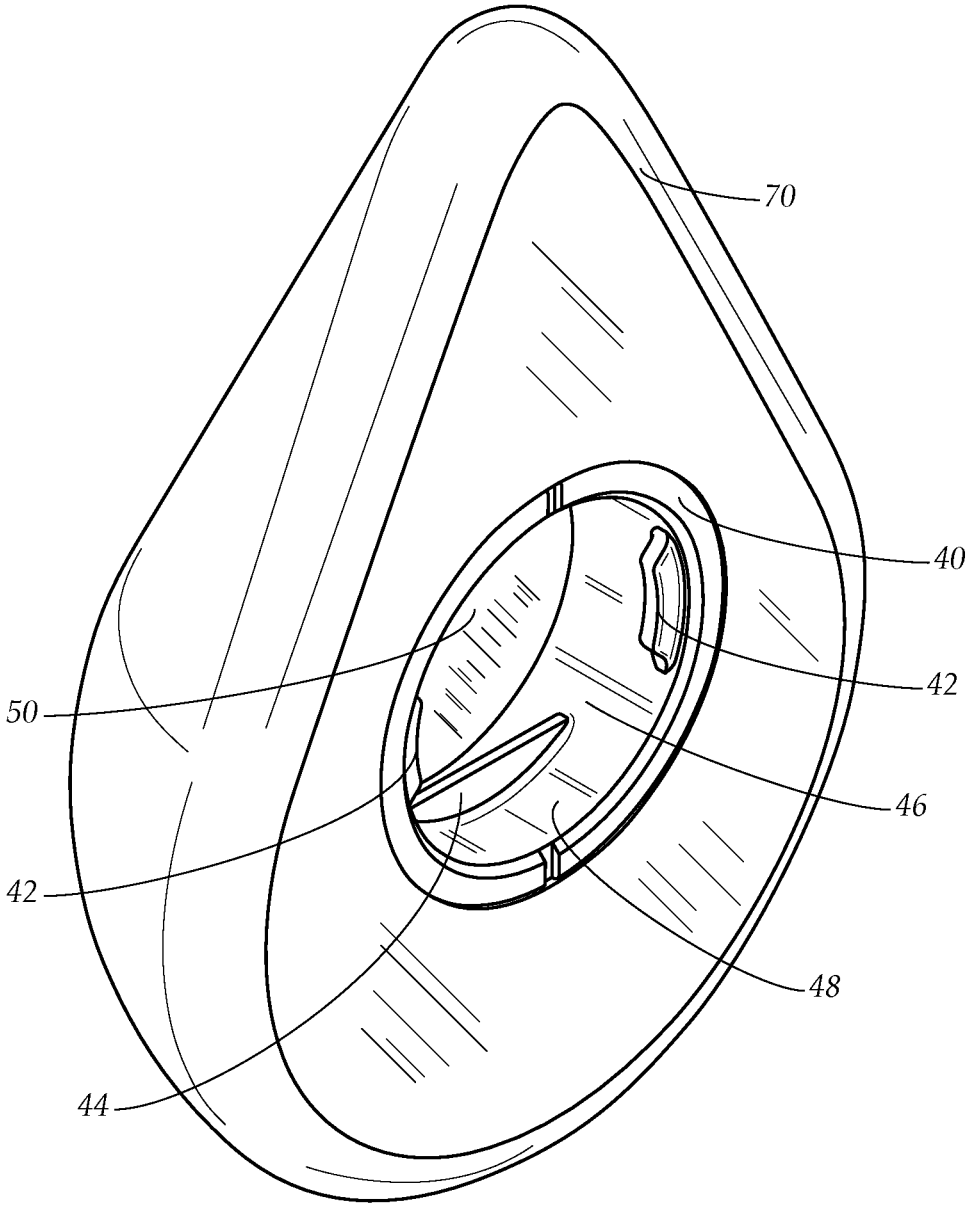
FIG. 8 is a perspective view of a locking anchor in place on an ornament.

FIG. 8 shows an ornament 70 with the anchor 40 in place. The ornament 70, for the sake of simplicity, is without any features in the drawing, to emphasize that the appearance of the ornament is not a limitation and the style, color, composition of materials, etc. of the ornament is not a limitation. Further, a first ornament 70 is interchangeable with a second ornament and the number of ornaments interchangeable with any one base is limitless. In one example embodiment, the anchor 40 is selectively attached to the ornament 70, rather than permanently attached.

Returning to FIGS. 12A, 12A',12B, 12B', 12C and 12C' to demonstrate the method of selectively fastening an ornament to the leather good once the base 20 is attached to the leather good.

A user aligns the first pair of flanges 42 on the anchor 40 attached to the ornament 70, shown in other drawings, with the flat sides 26 of the base 20 as the anchor 40 is placed over the base 20.

The user inserts the base 20 thus aligned into the cavity 48 of the anchor 40 and twists the anchor 40 one-half turn until the lip 22 of the base 20 engages the first pair of flanges 42, the second set of flanges 44 orthogonal to the first set of flanges 42, engaging the flat sides 26 of the base 20, preventing the base from further rotating.

The user pushes the base 20 deep into the cavity 48 of the anchor 40 until it clicks, the base 20 moving past the second set of flanges 44. The disk magnet 50 at an exit 54 of the cavity 48, discussed previously with regard to FIGS. 2A and 2 B, pulls the base 20 deeper into the anchor 40, the flat sides 26 of the base 20 flush against the second pair of flanges 44, further preventing the base 20 rotating within the cavity 48, locking the anchor 40 and base 20 together.

Figure 9:
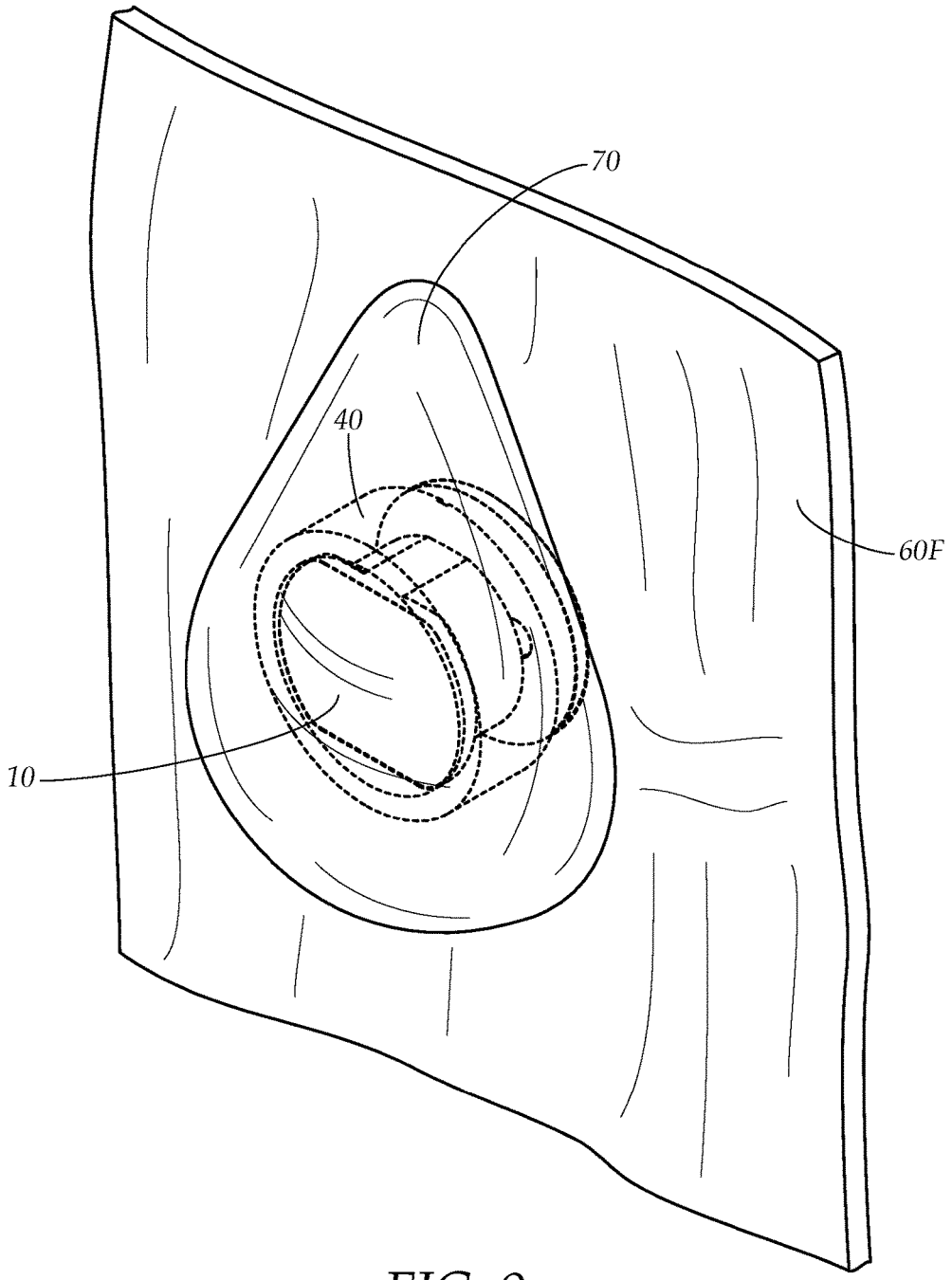
FIG. 9 is a perspective view of the ornament in place on the leather portion.

As shown in FIGS. 8 and 9, the disk magnet 50 is between the second pair of flanges 44 and the ornament 70, adjacent to the ornament inside the anchor cavity 48. The first pair of flanges 42 and the second pair of flanges 44 are in the cavity in the position described hereinabove.

The user removes the ornament 70 from the leather 60, by removing the anchor 40 from the base 20, thus removing the ornament 70 from the leather 60, by pulling the anchor 40 away from the base 20 until the second set of flanges 44 no longer engages the flat sides 26 of the base 20, rotating the anchor 40 one half-turn until the first set of flanges 42 no longer engages the lip 22 of the base 22, and lifting the anchor 40 off the base 20.

In one example embodiment, the step of removing the anchor 40 from the base 20 further comprises breaking the magnetic attraction between the disk magnet 50 and the base 20 when pulling the anchor 40 away from the base.

FIG. 9 shows the ornament 70 selectively attaching to the leather front 60F, held in place by the fastener assembly 10. A plurality of anchors 40, each with one ornament 70 attached interchangeably couple with the base.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a locking fastener assembly for attaching an ornament to clothing and accessories. The disclosure is illustrated by example in the drawing figures, and throughout the written description. It should be understood that numerous variations are possible, while adhering to the inventive concept. Such variations are contemplated as being a part of the present disclosure.

What is claimed is:

1. A fastener assembly for selectively attaching an ornament to a leather good, comprising:

an anchor configured for attaching to an ornament, the anchor an open collar defining a cavity therein, the cavity having an entry and an exit;

a first pair of opposing flanges inside said anchor, near the cavity entry;

a second pair of opposing flanges towards the cavity exit, orthogonal to the first pair of flanges;

a disk magnet covering the cavity exit substantially adjacent to the second pair of flanges; and a base configured for attaching to a leather good, the base having a core having a top, a pair of flat sides opposite each other, a pair of arcuate sides connecting the flat sides forming the core, the arcuate sides having a lip at the top of the base, such that when the anchor couples to the base, the lip engages said first pair of flanges of the anchor, said second pair of flanges engaging the flat sides preventing further rotation.

2. The fastener assembly as described in claim 1, wherein the base has a bottom with at least one rivet, the at least one rivet inserting into the leather good and fastening on a reverse side of the leather good by a grommet having at least one opening.

3. The fastener assembly as described in claim 2, wherein the base preferably has a pair of rivets fastening by a grommet preferably having a pair of openings.

4. The fastener assembly as described in claim 3, wherein the base permanently attaches to the leather good.

5. The fastener assembly as described in claim 4, wherein a plurality of anchors, each with one ornament attached interchangeably couple with the base.

6. A fastener assembly for selectively attaching an ornament to a leather good, comprising:

an anchor configured for attaching to an ornament, the anchor an open collar defining a cavity therein, the cavity having an entry and an exit, the anchor having a first pair of opposing flanges inside the collar near the entry to the cavity, the anchor having a second pair of opposing flanges near the cavity exit orthogonal to the first pair of flanges; and a base configured for attaching to a leather good, the base having a core having a top, a pair of flat sides opposite each other, a pair of arcuate sides connecting the flat sides forming the core, the arcuate sides having a lip at the top of the base, such that when the anchor couples to the base, the first pair of flanges align with the flat sides, the base inserting into the anchor, the anchor rotating such that the lip of the arcuate side of the base engages the first pair of flanges, the flat sides engaging the second pair of flanges preventing further rotation of the base.

7. The fastener assembly as described in claim 6, wherein the base has a bottom with at least one rivet, the at least one rivet inserting into the leather good and fastening on a reverse side of the leather good by a grommet having at least one opening.

8. The fastener assembly as described in claim 7, wherein the base preferably has a pair of rivets fastening to the leather good by a grommet having a pair of openings.

9. The fastener assembly as described in claim 8, wherein a disk magnet is between the second pair of flanges and the ornament.

10. The fastener assembly as described in claim 9, wherein the base permanently attaches to the leather good.

11. The fastener assembly as described in claim 6, wherein a plurality of anchors, each with one ornament attached interchangeably couple with the base.

12. A method of selectively fastening an ornament to a leather good, comprising:

attaching a base to a leather good, the base having a core having a top, a pair of flat sides opposite each other, a pair of arcuate sides connecting the flat sides forming the core, the arcuate sides having a lip at the top of the base;

aligning a first pair of flanges on an anchor attached to an ornament with the flat sides of the base as a collar of the anchor is placed over the base;

inserting the base into a cavity defined by the collar of the anchor and twisting the anchor a half turn until the lip of the base engages the first pair of flanges, a second set of flanges orthogonal to the first step engaging the flat sides of base, preventing the base from further rotating.

13. The method as described in claim 12, further comprises pushing the base deep into the cavity of the anchor until it clicks, the base moving past the second set of flanges, a disk magnet at an end of the cavity between the second set of flanges and the ornament, the disk magnet pulling the base deeper, the flat sides of the base flush against the second pair of flanges until it clicks, further preventing the base rotating within the cavity, locking the anchor and base together.

14. The method as described in claim 12, further comprises removing the anchor from the base by pulling the anchor away from the base until the second set of flanges no longer engages the flat sides of the base, rotating the anchor a half-turn until the first set of flanges no longer engages the lip of the base, and lifting the anchor off the base.

15. The method as described in claim 14, wherein the step of removing the anchor from the base further comprises breaking the magnetic attraction between the disk magnet and the base when pulling the anchor away from the base.

16. The method as described in claim 15, wherein the step of attaching the base to the leather good further comprises the steps of:

punching at least one hole in the leather good and inserting at least one rivet on a top portion of the base through the hole such that the rivet penetrates the leather to a reverse side; and placing a grommet having at least one hole over the at least one rivet and peening the rivet into the grommet.

* * * * *